United States Patent [19]

Hunter

[11] Patent Number: 4,577,725

[45] Date of Patent: Mar. 25, 1986

[54] VEHICLE MOUNTED FIRE ESCAPE CHUTE

[76] Inventor: Danny P. Hunter, 17226 Eddon, Melvindale, Mich. 48122

[21] Appl. No.: 610,955

[22] Filed: May 16, 1984

[51] Int. Cl.[4] ..... A62B 1/20

[52] U.S. Cl. ..... 182/48; 182/40; 182/2; 193/6; 193/16

[58] Field of Search ..... 182/48, 49, 40, 41, 182/137, 138, 2; 193/2 R, 5, 6, 16

[56] References Cited

U.S. PATENT DOCUMENTS

| | | | |
|---|---|---|---|
| 720,519 | 2/1903 | Haswell | 182/49 |
| 1,838,705 | 12/1931 | Robertson | 182/48 |
| 2,946,396 | 7/1960 | McDougal | 182/3 |
| 3,027,966 | 4/1962 | Johnson et al. | 182/49 |
| 3,027,967 | 4/1962 | Silver | 182/137 |
| 3,033,308 | 5/1962 | Miller | 182/48 |
| 3,063,513 | 11/1962 | Marryatt | 182/21 |
| 3,088,542 | 5/1963 | Johnson et al. | 182/48 |
| 3,125,377 | 3/1964 | Bridges | 182/138 |
| 3,339,690 | 9/1967 | Craig | 182/48 |
| 3,738,450 | 6/1973 | Hessler | 182/48 |
| 3,840,922 | 10/1974 | Morrison et al. | 5/350 |
| 3,843,150 | 10/1974 | Harada et al. | 280/150 |
| 4,099,595 | 7/1978 | Tracy | 182/48 |
| 4,246,980 | 1/1981 | Miller | 182/48 |

FOREIGN PATENT DOCUMENTS

| | | | |
|---|---|---|---|
| 2302248 | 1/1973 | Fed. Rep. of Germany | 182/137 |
| 2038257 | 7/1980 | United Kingdom | 182/48 |

*Primary Examiner*—Reinaldo P. Machado

*Attorney, Agent, or Firm*—Basile, Weintraub & Hanlon

[57] ABSTRACT

A telescoping, extensible fire escape chute is mounted on a vehicle carrying a telescoping boom having a passenger basket mounted at an upper end. The fire escape chute is formed of a plurality of telescoping sections which automatically extend and retract upon extension or retraction of the telescoping boom. Support cables under variable tension are attached to the sides of the chute to prevent sideways tipping of the chute during use. A deflatable cushion is mountable on the vehicle below the lower end of the chute and includes a plurality of vertically stacked inflatable members which, during deflation when a person or object strikes the cushion, gradually slow movement of the person or object in a controlled manner.

5 Claims, 6 Drawing Figures

VEHICLE MOUNTED FIRE ESCAPE CHUTE

BACKGROUND OF THE INVENTION

1. Field of the Invention

This invention relates, in general, to fire escape apparatus and, more specifically, to vehicle mounting fire escape apparatus.

2. Description of the Prior Art

Modern fire departments utilize a variety of methods and equipment to fight fires and to rescue people from burning buildings. Besides the conventional ladders and jump nets, it is common to utilize a truck mounted extensible boom carrying a passenger basket at an upper end. This device enables a fireman located within the basket to be raised several stories above the ground to either direct water onto the fire from a high vantage point or to rescue people trapped several stories above the ground.

While the extensible boom has provided versatility for fighting fires and rescuing people from burning buildings, it is not without its drawbacks. Typically, the passenger basket mounted on the end of the extensible boom is sized to hold only two people. Thus, a fire fighter in the basket can only rescue one person at a time from a burning building. In such a rescue attempt, the boom must be raised several stories above the ground and then retracted to deposit a person taken from the building safely on the ground. The boom must be extended again to rescue another person.

As can be seen, this is extremely time consuming since only one person at a time can be rescued. Thus despite the advantages provided by this type of fire fighting equipment, many people needlessly die each year in burning buildings since they cannot be safely removed from the building in time or they are afraid to jump into safety nets or use long extension ladders.

In an attempt to overcome this deficiency and enable many people to be safely removed from a burning building in the shortest amount of time possible, fire fighting vehicles have been provided with an escape chute which can be raised several stories above the ground to provide a convenient escape path for people to the ground. This type of equipment clearly has the advantage than many people can be sliding down the chute at the same time.

Such chutes are typically mounted on a vehicle and are constructed of several interconnecting sections which, when assembled, can be raised or pivoted as desired. However, such escape chute requires a vehicle dedicated for use of the escape chute vehicle only increases congestion at the scene of a fire.

Thus, it would be desirable to provide a fire escape chute apparatus which overcomes the problems encountered previously devised apparatus for rescuing people from burning buildings. It would also be desirable to provide a fire escape chute apparatus which enables many people to be safely removed from a building in the shortest amount of time possible. Finally, it would be desirable to provide a fire escape chute apparatus which does not require a specialized fire fighting vehicle for its use.

SUMMARY OF THE INVENTION

The present invention is a vehicle mounted fire escape chute. The chute is formed of a plurality of telescoping sections which are mounted on an extensible, telescoping boom, carrying a passenger basket at an upper end. The chute is automatically extended and retracted with extension and retraction of the boom.

Support means in the form of cables are attached to the sides of the chute and are placed under tension by means of a spring motor mounted on the vehicle to prevent sideway tipping of the chute.

A cushion including a plurality of separate, vertically stacked inflatable members is mounted on the vehicle at the bottom of the chute. Each of the inflatable members includes a pressure release valve which enables exhaust of air from the interior of of the members upon impact of a person or object on the cushion. The pressure within each inflatable member may be varied from the uppermost member to the lowermost member to provide a gradual deceleration of people or objects sliding down the chute when they impact upon the cushion.

The unique vehicle mounted fire escape chute of the present invention overcomes many of the problems encountered with previously devised portable fire escape chutes used to rescue people from the upper stories of burning buildings. The fire escape chute of the present invention enables many people to be safely removed from the upper stories of a building at one time.

More importantly, the fire escape chute of the present invention does not require a specialized fire fighting vehicle for its use such as prior art fire escape chutes which are mounted on a vehicle dedicated solely to the transport and use of a fire escape chute. The vehicle mounted chute of the present invention, on the other hand, is mountable on a vehicle mounted extensible, telescoping boom which carries passenger basket at an upper end and which forms a common part of today's fire department fire fighting equipment. By making the fire escape chute of the present invention mountable on a standard extensible boom, the overall costs of utilizing the chute are minimized, thereby making it affordable to many fire departments who already utilize a vehicle carrying an extensible boom.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
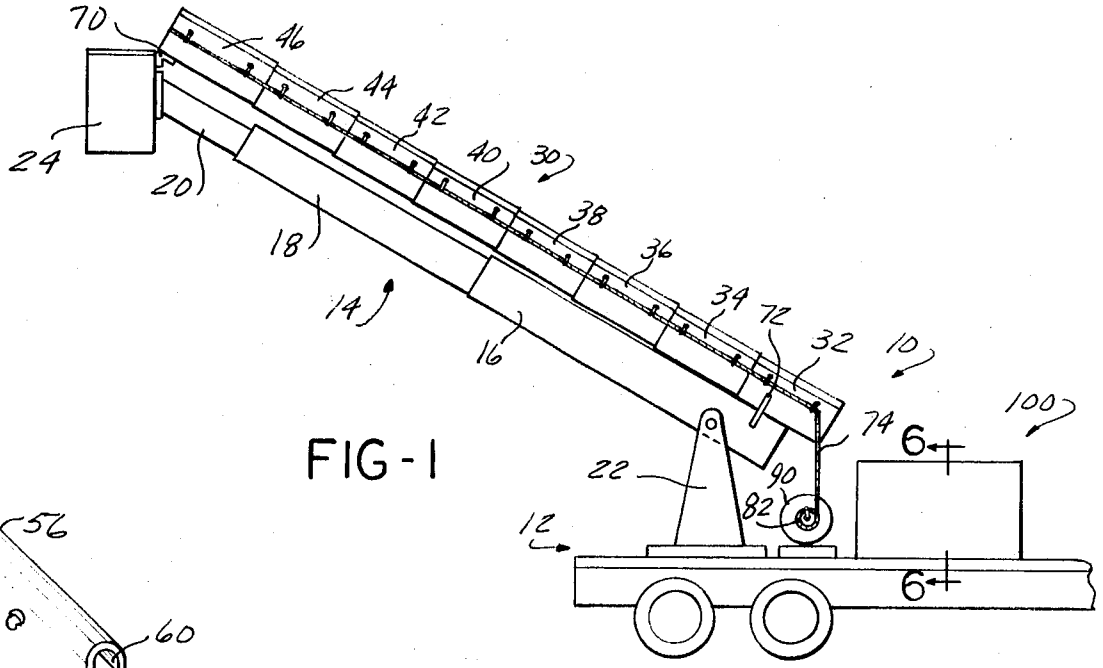
FIG. 1 is an elevational view showing the vehicle mounted fire escape chute apparatus of the present invention.

Throughout the following description and drawing, an identical reference number is used to refer to the same component shown in multiple figures of the drawing.

Referring now to the drawing, and to FIG. 1 in particular, there is illustrated a vehicle mounted fire escape chute 10 constructed in accordance with the teachings of the present invention. The fire escape chute apparatus 10 is constructed for use in rescuing people trapped in the upper stories of a burning building and enables many people to be removed from a burning building in the shortest time possible since many people can slide down the chute at the same time.

The fire escape chute apparatus 10 of the present invention includes a standard vehicle 12, such as a truck, which carries an extensible and retractable telescoping boom 14. The boom 14 is formed of a plurality of telescoping sections, such as sections 16, 18 and 20. The lowermost section 16 is pivotally mounted on a rotatable support 22 which is carried by the vehicle 12. A passenger basket 24 is mounted on the uppermost section 20 of the boom 14 and is sized to carry one or two people. Not shown in FIG. 1 is the conventional power apparatus for extending and retracting the boom 14, raising and lowering the boom 14, as well as rotating the base support 22 to move the boom 14 to any position. As such power equipment is conventional, it has been deleted from FIG. 1 for reasons of clarity.

Figure 3:
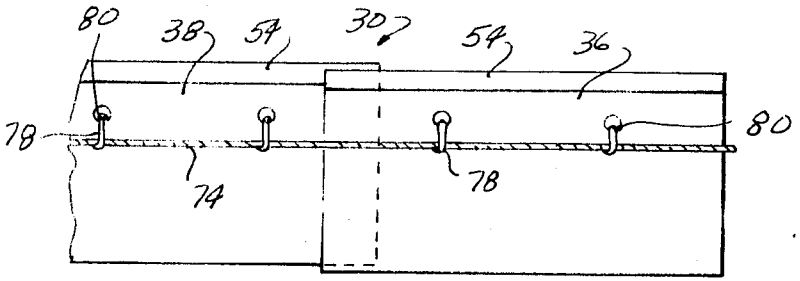
FIG. 3 is a side-elevational view of the chute sections shown in FIG. 2.
Figure 2:
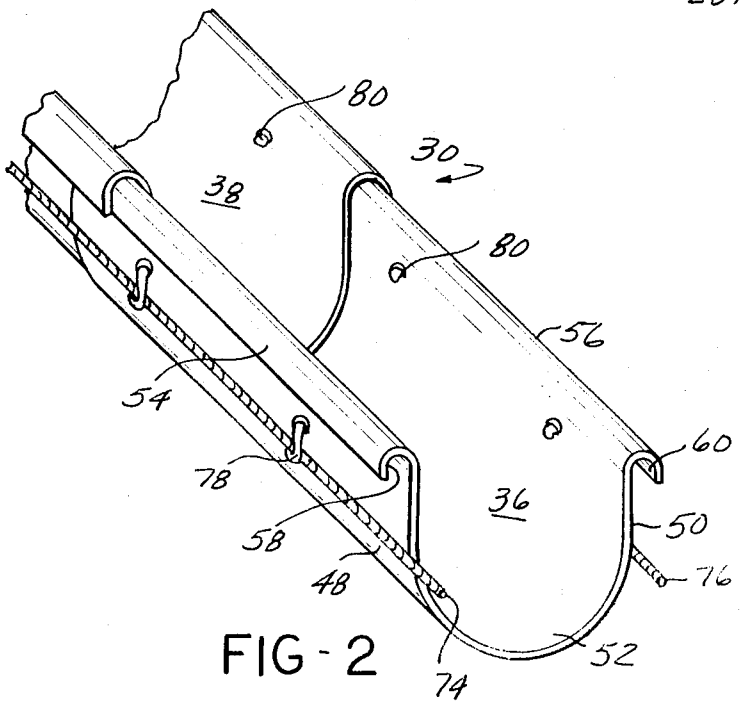
FIG. 2 is a partial, perspective view showing several telescoping chute sections.

As shown is FIG. 1 and in greater detail in FIGS. 2 and 3, an extensible and retractable, telescoping chute 30 is mounted on the telescoping boom 14. The chute 30 is formed of a plurality of U-shaped sections, such as sections 32, 34, 36, 38, 40, 42, 44 and 46. Each of the sections, such as sections 36 and 38 shown in FIGS. 2 and 3, is formed with opposed side walls 48 and 50, a bottom 52 and an open top. The upper ends 54 and 56 of side walls 48 and 50, respectively of each chute section are bent over to form inverted channels 58 and 60.

The size of each chute section as well as the overall dimensions of the inverted channels 58 and 60 formed at the upper ends of each chute section gradually increase in size from the lowermost chute section 32 to the uppermost section 46. In this manner, the channels 58 and 60 of a higher chute section, such as chute section 38, will telescoping and slidingly receive the channels 58 and 60 of the adjacent, lower chute section, such as chute section 36.

As shown in FIG. 1, the uppermost chute section 46 is connected to the passenger basket 24 by means of a mounting bracket 70. Mounting straps 72, only one of which is shown in FIG. 1, are used to attach the lowermost chute section 32 to the telescoping boom 14.

Figure 4:
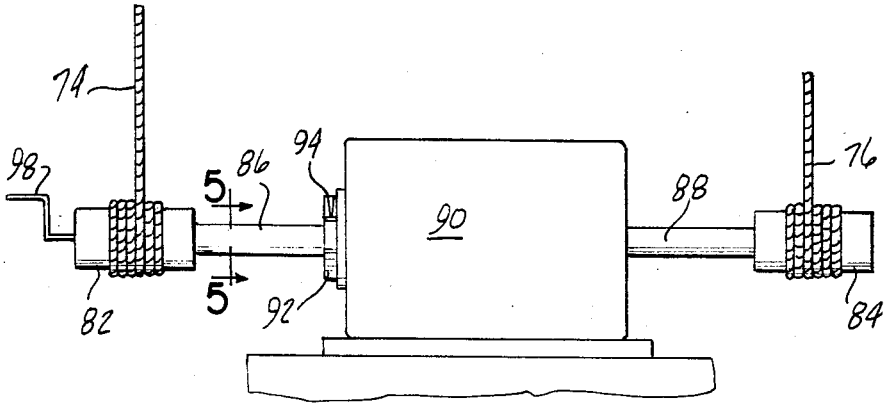
FIG. 4 is a front elevational view of the spring motor and cable tensioning means utilized in the fire escape chute of the present invention.
Figure 5:
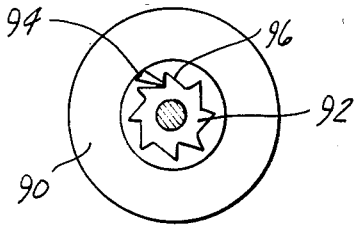
FIG. 5 is a cross-sectional view generally taken along line 5—5 in FIG. 4.

Referring now to FIGS. 1, 4 and 5, there is illustrated chute support means which are utilized to prevent sideways or tipping movement of the chute 30 when the chute 30 is in its extended position and people or objects are sliding down the extended chute 30. The chute support means includes cables 74 and 76 disposed on opposite sides of the chute 30. The cables 74 and 76 are attached to the chute 30 by means of a plurality of hooks 78 which are attached at one end to apertures 80 formed in each chute section and at another end to the cables 74 and 76.

The cables 74 and 76 are wound about steel drums 82 and 84 which are mounted on rotatable shafts 86 and 88 connected to a conventional spring motor 90. The spring motor 90 is mounted on the vehicle 12 and places the cables 74 and 76 under tension by applying a force acting to constantly urge the cable 74 and 76 in a direction towards the drums 82 and 84. This tension provides rigidity on opposite sides of the chute 30 which limits sideways tipping or movement of the chute 30.

Lock means in the form of a ratchet 92 and pivotal pawl 94 are mounted on the shaft 86. The ratchet 92 includes a plurality of wedge shaped teeth 96 which are engaged by the pawl 94 in one direction to prevent rotation of the shaft and yet enables the pawl 94 to pivot over each wedge section 96 when the spring motor 90 is rotated in an opposite direction. In this manner, a crank handle 98, as shown in FIG. 4, may be inserted into the end of the shaft 86 to rotate the shaft 86. This causes the pawl 94 to slide over one wedge shaped tooth 96 on the ratchet 92 and engage a succeeding wedge tooth 96. In this manner the spring motor exerts increased tension on the cables 74 and 76 and increases the support provided by the cables 74 and 76 on the sides of the chute 30.

The vehicle mounted fire escape chute apparatus 10 of the present invention also includes an impact cushion 100 which is mounted on the vehicle beneath the lower end of the chute 30. The cushion 100, as shown in FIG. 1 and in greater detail in FIG. 6, includes an outer cover 102 having a hollow interior. The shape or form of the cover 102 is not critical to the use of the cushion 100 and can be provided in any convenient form such as a rectangular cross-section, circular, etc.

Figure 6:
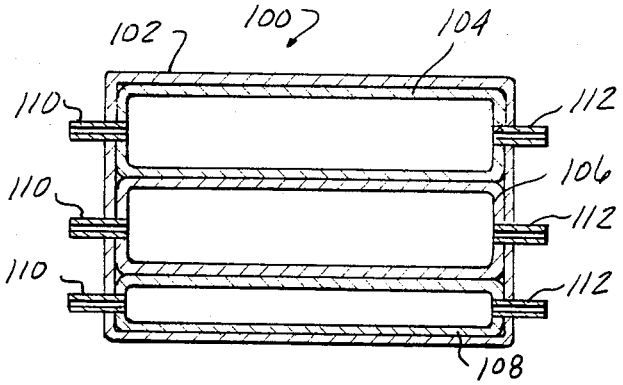
FIG. 6 is a cross-sectional view generally taken along line 6—6 in FIG. 1 and showing the construction of the cushion utilized in the fire escape chute of the present invention.

A plurality of vertically stacked, inflatable members are disposed within the interior of the outer cover 102. As shown in FIG. 6, by way of example only, three inflatable members 104, 106 and 108 are disposed within the cover 102.

Each of the inflatable members 104, 106 and 108 is provided with an inlet valve 110 and an outlet pressure release valve 112. The inlet valves 110 enable each inflatable member 104, 106, and 108 to be quickly inflated. The outlet pressure release valves 112 provide an exhaust of the air within each inflatable member 104, 106 and 108 when a person or object impacts on the cushion 100.

Due to the vertical arrangement of the inflatable members 104, 106 and 108, a person or object striking the cushion 100 is gradually decelerated in a controlled manner since the uppermost inflatable member 104 would be defined first thereby absorbing some of the momentum of the person or object before the subsequent inflatable members will be deflated. It is also possible to provide increased pressure in the lowermost inflatable members, such as inflatable members 106 or 108 or to provide varyingly increasing pressure in the lowermost inflatable members 104, 106 and 108 to vary the deceleration rate. After the inflatable members have been deflated, they can be quickly re-inflated through the inlet valves 110 for any convenient pressurized air source, such as that commonly available on the vehicle 12.

Although not shown, the fire escape chute apparatus 10 may also be provided with a conventional manually operated or powered winch positioned at the upper end of the chute 30 or in the passenger basket 24 attached to the telescoping boom 14. The winch may be used to lower people or objects down the chute 30 while they are afraid to slide down the chute 30 or who are unable to do so due to injuries.

Also, the fire escape chute 30 may be provided on the base or bottom 52 of each chute section with a roughened center portion to enable people to walk down the chute 30 instead of sliding down the chute 30. This feature can be utilized only on lower stories of the building since the greater height of upper stories would create too steep an angle on the chute 30 for persons to safely walk down the chute 30.

In summary, there has been disclosed an unique vehicle mounted fire escape chute apparatus which enables many people to be safely removed from a burning building in the shortest amount of time possible. The fire escape chute of the present invention is uniquely mounted on conventional fire fighting vehicle having a extensible and retractable telescoping boom which carries a passenger basket at an upper end. This minimizes the cost of the chute apparatus since it can be added to an existing vehicle carrying a telescoping boom and does not require a dedicated vehicle as in previously devised portable fire escape chute apparatus.

What is claimed is:

1. A fire escape chute for use on a vehicle having an extensible boom with a passenger basket attached at an upper end comprising:

a fire escape chute mounted on the boom, the chute including a plurality of telescoping chute sections; and means for supporting the sides of the chute, the supporting means including:

cables attached to opposite sides of the chute sections; and means, mounted on the vehicle, for applying tension to the cables to limit sideways movement of the chute sections.

2. The fire escape chute of claim 1 wherein the means for applying tension comprises:

spring motor means mounted on the vehicle for applying tension in one direction to the cables;

first and second rotatable shafts extending outward from the spring motor means; and drums, mounted on the ends of the first and second shafts for receiving the cables.

3. The fire escape chute of claim 2 further including means for preventing rotation of the spring motor means in one direction.

4. The fire escape chute of claim 3 wherein the means for preventing rotation of the spring motor means in one direction comprises:

a ratchet mounted on one of the rotatable shafts, the ratchet having a plurality of circumferentially spaced wedge-shaped teeth; and a pivotal pawl for lockingly engaging the teeth in one direction to prevent rotation of the ratchet in the one direction.

5. The fire escape chute of claim 1 further including:

an impact cushion mounted on the vehicle below the bottom of the chute, the impact cushion comprising:

a plurality of vertically stacked inflatable members;

pressure release means formed on each inflatable member for exhausting pressure therefrom;

inflating means formed on each inflatable member for inflating each inflatable member; and wherein the inflatable members are provided with different inflation pressures varying in the vertical direction.

* * * * *